US005911319A

United States Patent [19]

Porcelli et al.

[11] Patent Number: 5,911,319

[45] Date of Patent: Jun. 15, 1999

[54] BLISTER PACKAGE FOR ORAL HYGIENE APPLICATORS

[75] Inventors: V. Lorenzo Porcelli, Ossining, N.Y.; John Stoltzfus, Sherman Oaks, Calif.

[73] Assignee: John J. Stoltzfus, Sherman Oaks, Calif.

[21] Appl. No.: 09/055,429

[22] Filed: Apr. 6, 1998

Related U.S. Application Data

[63] Continuation-in-part of application No. 08/854,320, May 12, 1997, Pat. No. 5,794,774.

[51] Int. Cl.[6] ..... A61B 17/06

[52] U.S. Cl. ..... 206/63.5; 206/534.1; 206/539; 206/368

[58] Field of Search ..... 206/531, 534.1, 206/532, 539, 368, 369, 370, 460, 469, 471, 361, 362, 362.4, 63.5, 461, 823

[56] References Cited

U.S. PATENT DOCUMENTS

| | | | |
|---|---|---|---|
| 3,070,102 | 12/1962 | MacDonald | 206/460 |
| 3,780,856 | 12/1973 | Braverman | 206/539 |
| 3,905,113 | 9/1975 | Jacob | 32/40 R |
| 3,924,746 | 12/1975 | Haines | 206/530 |
| 4,011,949 | 3/1977 | Braber et al. | 206/532 |
| 5,348,153 | 9/1994 | Cole | 206/361 |
| 5,440,774 | 8/1995 | Cole | 15/105 |
| 5,758,774 | 6/1998 | Leblong | 206/531 |
| 5,775,505 | 7/1998 | Vasquez et al. | 206/538 |
| 5,794,774 | 8/1998 | Porcelli | 206/369 |

*Primary Examiner*—Paul T. Sewell
*Assistant Examiner*—Nhan T. Lam
*Attorney, Agent, or Firm*—Michael Ebert

[57] ABSTRACT

A blister package for storing an array of oral hygiene applicators, each formed from a circular base having bristles anchored thereon which are impregnated with a dentifrice. The underside of the base is coated with a pressure-sensitive adhesive whereby when the applicator is adhered to a fingertip of a user, it then functions as a toothbrush. The package includes a card of synthetic plastic film material molded to define an array of blisters. Sealed to the card is a backing sheet having an array of applicators releasably adhered thereto, each applicator being nested in a respective blister in the card. The package is divided by lines of perforation into separable cells, each enclosing an applicator. In use, a cell is separated from the package, its backing sheet is peeled off to expose the applicator, and the applicator is then detached from the sheet and applied to a finger tip of the user.

8 Claims, 3 Drawing Sheets

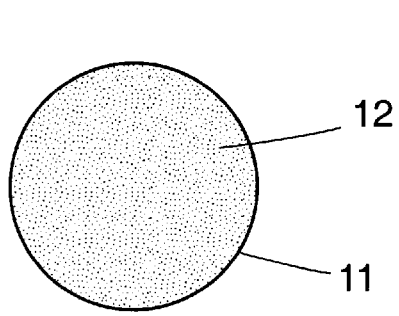
FIG. 1
FIG. 2
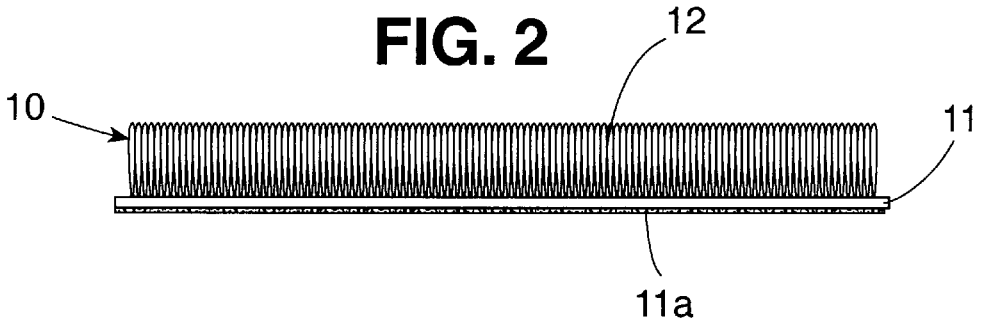
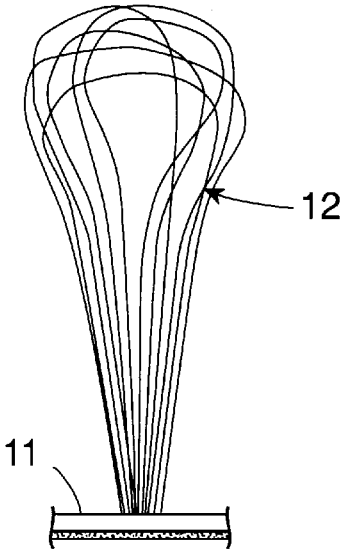
FIG. 3
FIG. 4
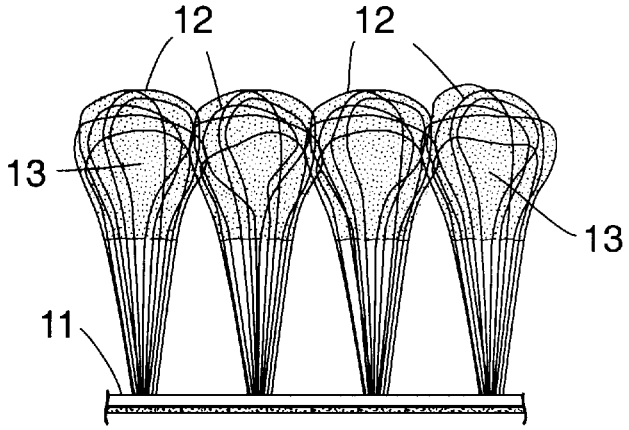

BLISTER PACKAGE FOR ORAL HYGIENE APPLICATORS

RELATED APPLICATION

This application is a continuation-in-part of the copending application Ser. No. 08/854,320, filed May 12, 1997, now U.S. Pat. No. 5,794,774, entitled "DISPOSABLE ORAL HYGIENE APPLICATOR."

BACKGROUND OF INVENTION

1. Field of Invention

This invention relates generally to oral hygiene finger-tip applicators for cleaning the teeth and massaging the gingival tissues in an oral cavity, and more particularly to a blister package for storing an array of such applicators.

2. Status of Prior Art

To maintain oral hygiene and prevent bacterial buildup causing plaque to form on the surface of the teeth which if not removed may result in periodontal disease, the teeth must be cleaned at regular and frequent intervals. And to maintain the gingiva or gums in a healthy condition, the gums must be massaged and stimulated. To promote oral hygiene, it is customary to use a toothbrush for this purpose having a long, rigid plastic handle on the end of which is mounted a set of bristles to which a dentifrice in cream or powder form is applied.

When available, a conventional toothbrush is a satisfactory oral hygiene implement. However, there are many situations in public or private places away from home where a toothbrush and a dentifrice are not available. Thus while it is desirable after dining in a restaurant to then brush the teeth to remove food particles therefrom, it is usually inconvenient for an individual to carry a toothbrush on his person. And it is a common occurrence for travelers and overnight guests to forget to bring along their own toothbrush as well as a tube of toothpaste. Yet one is ill advised to neglect oral hygiene even for a day, particularly after meals.

To make it possible for an individual to carry on his person a disposable and highly compact toothbrush and also a dentifrice sufficient for a single application, the prior art discloses various oral hygiene implements suitable for this purpose.

Thus the U.S. Pat. No. 3,905,113, to Jacobs discloses a dental health tool in the form of a flexible, generally oval strip that is adherable to a fingertip, nylon bristles being mounted on the strip. Deposited on the oval strip between the bristles is a dry dentifrice.

In our above-identified copending patent application there is disclosed a disposable oral hygiene applicator attachable to the ball of a user's fingertip whose finger then functions as an articulated handle by which the applicator may be inserted in the oral cavity and applied omnidirectionally to sweep and clean the teeth and to massage the gingival tissues. The applicator includes a circular flexible base dimensioned to cover mainly the round ball of the fingertip, the underside of the base having a layer of pressure-sensitive adhesive thereon. Anchored on the base and projecting upwardly therefrom is a dense array of multi-strand filamentary loops, a viscous dentifrice being entrapped in the loops.

Also disclosed in this copending application is a supply package in a credit card format in which six applicators are stored in individual cells. The package includes a card having an array of holes therein, each forming a cell to accommodate a respective applicator of the group. A metal foil sheet is bonded to the underside of the card to close the cells, and a like array of collapsible domes are joined to the upper side of the card to enclose the respective cells containing the applicators. In use, a selected applicator is released from the card by pressing and collapsing the dome enclosing the applicator to force the applicator to rupture the metal foil sheet and emerge from its cell.

The practical drawback of a supply package in a credit card format of the type disclosed for storing an array of six applicators is that each applicator is not effectively housed in an individual package. Thus when an individual applicator is forced out of the multi-applicator package, the package remains basically unchanged except for the fact that one of the domes is now empty and the foil under this dome is ruptured. Hence the package, when full, takes up the same space as when there is only one applicator left in the package.

If therefore an individual intends to spend a few hours away from home and wishes to take along only a single oral hygiene finger-tip applicator so that he can brush his teeth in a restaurant rest room after dining in that restaurant, he cannot do so with a multi-applicator supply package of the above-described type.

SUMMARY OF INVENTION

In view of the foregoing, the main object of this invention is to provide a blister package for storing an array of oral hygiene finger tip applicators; the package being divided into detachable cells, each containing a single applicator.

More particularly an object of this invention is to provide a package of the above type in which each applicator is adherable to the ball of a fingertip, whereby the user's finger then functions as an articulated handle by which the applicator may be inserted in the oral cavity and applied to the teeth and to the gingival tissues to effect cleaning and massaging actions promoting oral hygiene without injury to the teeth or gums.

Also an object of the invention is to provide a highly compact package for a set of applicators, each occupying a separate detachable cell so that the package may be stored in a pocket, a wallet or elsewhere on the person of the user, or one can detach a single cell from the package to be carried by the user.

Yet another object of this invention is to provide a multi-applicator supply package which can be mass-produced at relatively low cost.

Briefly stated, these objects are attained by a blister package for storing an array of oral hygiene applicators, each formed from a circular base having bristles anchored thereon which are impregnated with a dentifrice. The underside of the base is coated with a pressure-sensitive adhesive whereby when the applicator is adhered to a fingertip of a user, it then functions as a toothbrush.

The package includes a card of synthetic plastic film material molded to define an array of blisters. Sealed to the card is a backing sheet having an array of applicators releasably adhered thereto, each applicator being nested in a respective blister in the card. The package is divided by lines of perforation into separable cells, each enclosing an applicator. In use, a cell is separated from the package, its backing sheet is peeled off to expose the applicator, and the applicator is then detached from the sheet and applied to a finger tip of the user.

BRIEF DESCRIPTION OF DRAWING

For a better understanding of the invention, as well as other objects and further features thereof, reference is made to the following detailed description to be read in conjunction with the accompanying drawing, wherein:

FIG. 1 is a top view of an oral hygiene applicator in accordance with the invention;

FIG. 2 is a side view of the applicator;

FIG. 3 is a greatly magnified view of a single bristle in the applicator;

FIG. 4 is a magnified side view of a row of bristles and the dentifrice embedded therein;

DETAILED DESCRIPTION OF INVENTION

The Applicator

Figure 5:
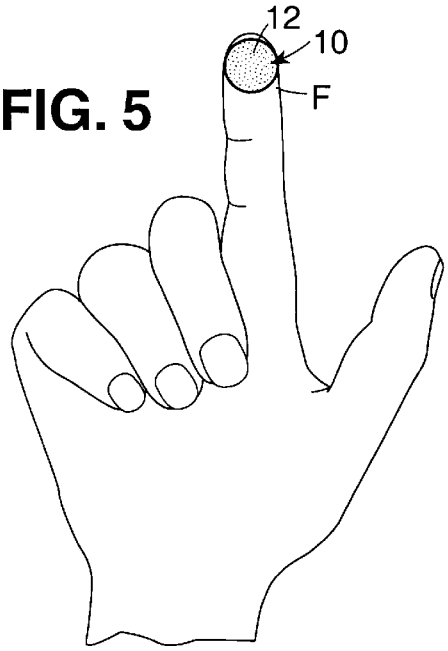
FIG. 5 illustrates the applicator attached to a fingertip ball of a user.

Referring now to FIGS. 1 to 4, illustrated in these figures is a single, oral hygiene applicator 10 in accordance with the invention. The applicator is disc-shaped so that it may be attached and conformed to the round ball of the fingertip of the user's index or forefinger. The diameter of the applicator is such that it covers mainly the round ball of the typical fingertip and not the rest of the fingertip. The applicator is therefore effectively a large dot and as such, is easily applied to the fingertip.

Dental hygiene applicator 10 is constituted by a flexible circular base 11 fabricated of woven nylon or other synthetic plastic or natural fibers on which is anchored a dense circular array of upwardly-projecting bristles 12. Each bristle 12, as best seen in FIG. 3 which shows the bristle in highly magnified form, is formed by a multi-strand loop created by fine filaments of nylon or similar material which are interwoven with base 11 to define a three-dimensional miniature bulb. As shown in FIG. 4, embedded in each bulb forming a bristle 12 is a dentifrice 13 in a viscous paste form which is entrapped within the strands that define the bulb.

Because bristles 12 are not constituted by individual cut filaments, as in a conventional toothbrush, but take the form of multi-strand loops, these loops have a dual advantage. The loops act to entrap the dentifrice so that it remains on the applicator until the applicator bristles are pressed against the teeth and the dentifrice is then extruded form the bristles. The loops also serve to prevent damage to the teeth surface, for the rounded ends of the strands while define the bulb of the loops are far less abrasive than the ends of cut filaments, even those having rounded ends. And since each bulb is formed by nylon filament strands having a diameter much finer than that of a conventional toothbrush nylon bristle, the applicator bristles are more flexible than those of a conventional tooth-brush and create a softer brush.

In practice, the dentifrice may include plaque control, tooth whitener, fluoride, medication and other ingredients useful in promoting oral hygiene. Because each applicator is stored in a sealed cell in a manner to be later described, the dentifrice embedded in the applicator is maintained in a sterile and usable state for a prolonged period.

Coated on the underside of base 11 of the applicator is a layer 11A of high tack pressure-sensitive adhesive whose composition is such that it is insoluble in water and non-reactive with saliva so that the applicator remains attached to the finger when in the mouth.

Operation of Applicator

Figure 6:
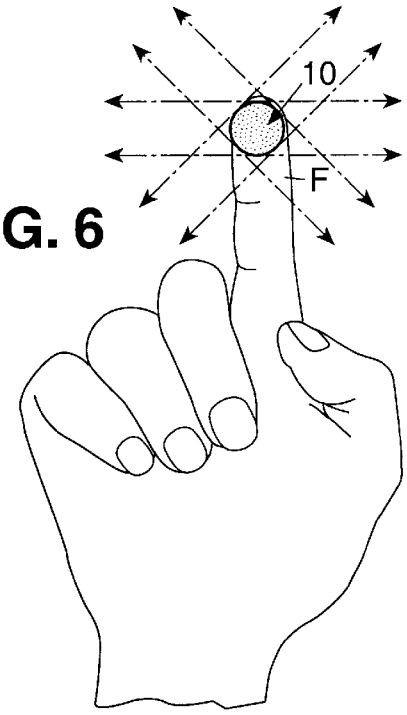
FIG. 6 illustrates the omnidirectional characteristics of the applicator.

Applicator 10, as shown in FIG. 5, is adhered and conforms to the round ball of a fingertip F of the user's index finger. Because the applicator is disc-shaped, and the bulbous bristles 12 thereon are in a dense circular array, the applicator is free of corners, and other discontinuities and presents an arcuate front regardless of its direction of movement. The applicator therefore functions as an omnidirectional brush, as shown in FIG. 6, that can be manipulated to sweep in any direction as indicated by the arrows. Regardless of how the applicator is positioned with respect to the teeth and gums, its bristles are always properly oriented. When applied to the teeth, the bristles snap into the crevices between teeth more readily than a conventional toothbrush in which the bristles are arranged in horizontal rows in a rectangular array.

Also, since the disc-shaped applicator is attached to a finger that functions effectively as an articulated handle, as contrasted to the stiff, unarticulated handle of a conventional toothbrush, the applicator may be applied to regions of the teeth and gums in the dental cavity which are otherwise difficult to reach with a conventional toothbrush. A finger has tactile sensitivity; hence when an applicator is attached to the ball of the fingertip, the finger can apply whatever pressure is necessary to effectively scrub the engaged dental surface. With a conventional handled toothbrush, this is not possible.

A finger ball is "the padded rounded underside of a human finger or toe near the tip" (Webster's Third New International Dictionary). The dimensions of the circular base of an applicator in accordance with the invention are such as to mainly cover this round ball and not the rest of the fingertip. In practice, an applicator having a diameter of about ¾ of an inch will cover the typical rounded ball or a user's fingertip.

While no two users have fingertip balls of exactly the same size, an applicator in accordance with the invention is substantially confined to this round ball and its omnidirectional operating characteristics are based on this relationship. The fingertip is the most sensitive part of the finger, and with this fingertip one can manipulate the dental applicator attached to its ball to sweep over all front and rear surfaces of the teeth in any direction, far better than with a standard, rectangular toothbrush or with an applicator having a non-circular shape and therefore lacking in omnidirectional characteristics.

Utility

The usefulness of an applicator in accordance with the invention is not limited to those situations where the user lacks access to a regular toothbrush. Indeed, the applicator by reason of its omnidirectional characteristics and the fact that the articulated, tactilely-sensitive finger of the user serves as its handle, has distinct advantages over a conventional toothbrush, particularly in the case of pre-school children.

These children are taught by their parents that proper oral hygiene is important and therefore the teeth should be brushed vigorously at least twice every day. But a pre-school child finds it difficult to insert a toothbrush in his mouth without striking the wall of the dental cavity, and he finds it even more difficult to manipulate the toothbrush in a prescribed manner.

A recommended motion for brushing the teeth takes into account the orientation of the bristles on a conventional handled toothbrush, so that for an effective scrubbing action, the brush should be manipulated to sweep over the teeth surfaces in a circular orbit. This is not difficult for an adult to carry out, but a pre-school child has to be carefully taught how to manipulate a toothbrush. Because of the difficulties experienced in brushing with regular toothbrushes, many pre-school children tend to avoid brushing their teeth.

But with an omnidirectional applicator in accordance with the invention, a pre-school child will willingly adopt a proper approach to oral hygiene, for there is no need to first apply toothpaste to the brush (another problem), and the child has no difficulty in putting a finger in his mouth, and in fact may enjoy doing so, for this is an action he has practiced since babyhood.

And the child can then brush his teeth in any random way he pleases. He need not produce an orbital motion; for as long as the applicator sweeps across the teeth in any direction, as shown in FIG. 6, a cleansing action will take place. And, after the teeth have been cleaned, and the gums massaged, there is no need, as with a conventional toothbrush, to rinse the brush and put it back in a holder, for all the child need now to do is to detach the applicator from his finger and discard it. With a conventional toothbrush which is put to repeated use, it is important that the brush be maintained in sterile condition. But applicator 10 is disposable and a fresh applicator is used each time it is put to use.

Supply Package

Figure 7:
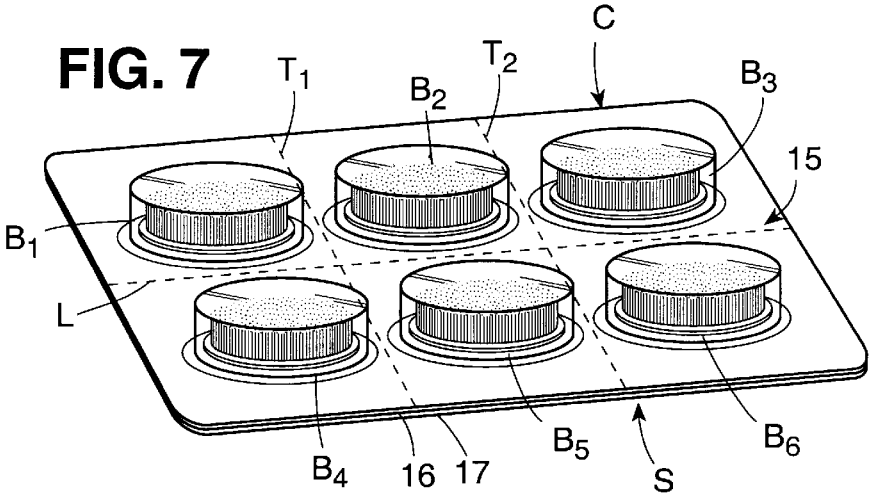
FIG. 7 is a perspective view of a supply package in a credit card format in accordance with the invention in which six applicators are stored in individual cells.
Figure 8:
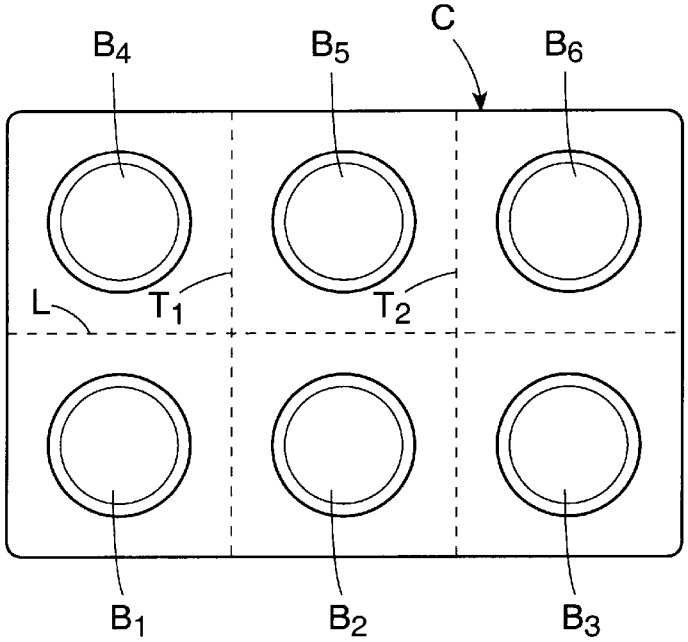
FIG. 8 is a plan view of the molded blister card included in the package.

As shown in FIGS. 7 and 8, a compact supply package 15 in accordance with the invention is in a credit card format which serves to protectively store in sterile condition in individual cells, six oral hygiene applicators 10 of the type shown in FIG. 1. Package 15 includes a card C whose rectangular dimensions are about the same as those of a standard credit card. Card C is formed of a transparent plastic film material, such as thermoplastic polyvinyl chloride or polyethylene. The card is molded by heat and pressure to define a rectangular array of six circular blisters $B_1$ to $B_6$ which project above the planar surface of the card. Each blister forms a circular cell to accommodate a respective applicator 10 of the type shown in FIG. 1. The dimensions of the blister are somewhat larger than those of the applicator nested therein.

Heat sealed or otherwise joined to card C is a backing sheet S preferably formed by a laminate of a metal foil 16, such as aluminum foil and paper 17. Seated on the foil side of backing S at positions in registration with the array of blisters on the card C is a rectangular array of applicators 10. Hence when the backing sheet is joined to the card, the applicators then all lie within the blisters.

When seating the applicators on the foil side of backing sheet S, the pressure-sensitive adhesive layer 11A on the underside of the circular base 11 of the applicator then engages and adheres to the foil surface to hold the applicator in place.

In order to be able to easily detach an applicator seated on the backing sheet when the applicator is to be put to use, one must provide a weak bond between the foil side of the backing sheet S and the pressure-sensitive adhesive layer 11A on the underside of the applicator.

To this end the surface of the metal foil side of the backing sheet may be vapor-coated with a release agent, such as a film of PTFE (Teflon). Or one can join to the surface of the foil a small disc which has poor sticking characteristics. Thus the disc could be formed of paper having a high gloss on its outer surface, the undersurface being joined to the surface of the foil by a double-faced adhesive tape.

As shown in FIGS. 7 and 8, the multi-applicator supply package is divided into individual cells by a long line of perforations L extending through the longitudinal center of the card, line L being intersected by equispaced transverse lines of perforations $T_1$ and $T_2$ to divide the package into six like sections, each containing a single applicator cell.

Figure 10:
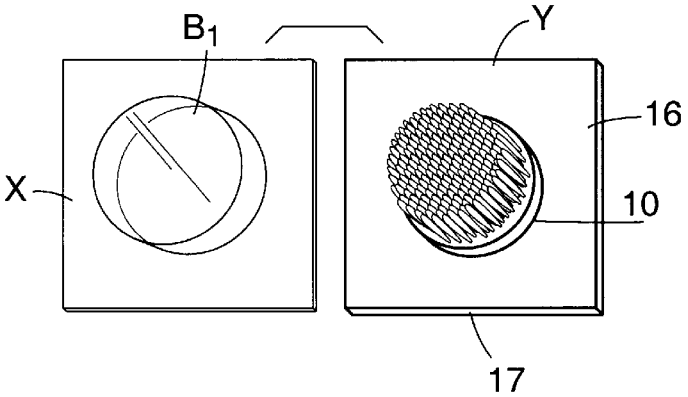
FIG. 10 illustrates a single cell whose backing sheet carrying an applicator has been peeled off the blister section of the cell.

Thus when a user wishes to obtain an applicator 10 to apply to his finger tip, he then tears off one of the perforated sections, and peels off its backing sheet S. This is illustrated in FIG. 10 in which X is the section of the package containing blister $B_1$ and Y is in the corresponding section of the backing sheet pulled off section X. It will be seen that seated on the foil side 16 of section Y is an applicator 10.

All the user need to do now is to detach applicator 10 from section Y and apply it to his finger tip, sections X and Y then being discarded.

Thus each time a section of the multi-applicator package is torn off, the package is reduced in size. And when a user intends to be away from home for just a few hours or a day, he then takes along the one or two applicators he requires for his trip, not the entire package.

Modification

Figure 9:
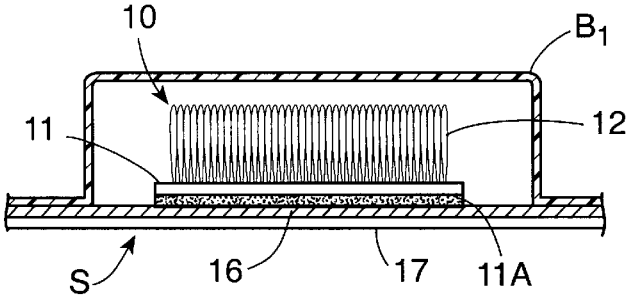
FIG. 9 is a section taken through one of the cells.

In the cell arrangement shown in FIG. 9, the pressure-sensitive adhesive layer 11A on the underside of base 11 of applicator 10 engages and adheres to the metal foil side 16 of the foil-paper laminate of backing sheet S. In order that applicator 10 be easily detachable from backing sheet S when the applicator is to be put to use, the adhesion of the applicator to the foil side of the backing sheet must be weak. It is also desirable, when peeling the applicator off the backing sheet, that little adhesive remain behind.

Figure 11:
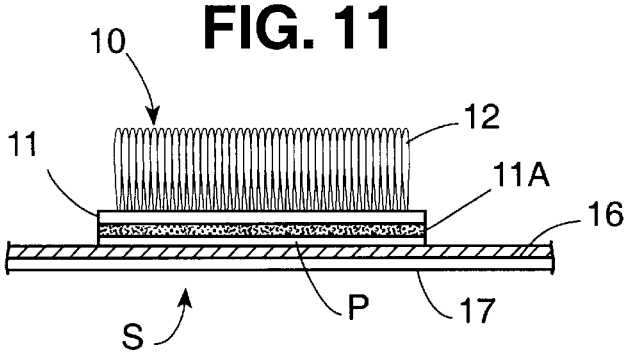
FIG. 11 shows a modified cell arrangement.

A preferred arrangement for mounting each applicator 10 on the foil side 16 of the backing sheet S is shown in FIG. 11 in which the adhesive layer 11A of applicator 10 is weakly adhered to the face of a paper disc P whose underside is strongly adhered to the foil side 16 of backing sheet S.

Paper disc P has a small diameter substantially matching the diameter of base 11 of applicator 10. Paper disc P makes possible high speed production in which use is made of a paper ribbon from which the paper discs are die cut. In production, an array of applicators 10 are laid down on the paper ribbon to adhere thereto at uniformly spaced positions. The paper ribbon having the array of applicators mounted thereon are then kiss cut into paper discs which are strongly adhered onto the metal face side 16 of backing sheet S. While paper discs P adhere firmly to the foil side 16 of backing sheet S, it allows the user to peel off applicator 10 from the backing sheet without difficulty. When applicator 10 is peeled off, paper disc P remains attached to the backing sheet and is discarded with the backing sheet, for it has served its purpose.

In practice, the paper ribbon from which the paper discs are derived is preferably provided with an outer coating for which the adhesive in adhesive layer 11A of the applicator 10 has a low affinity so that the applicator is easily peeled off without leaving any adhesive behind on the coating.

A package in accordance with the invention is not limited to the embodiment illustrated on which the package stores six applicators, for the package may be arranged to have a lesser or greater number of applicators. And the package need not be in a credit card format, but may take the form of a long strip having a single row of cells and perforations dividing the strip into cell sections.

Or the package may assume the form of a circular card divided by perforations into six sectors, each having a blister storing an applicator.

While there has been shown and described preferred embodiments of a blister package for oral hygiene applicators in accordance with the invention, it will be appreciated that many changes may be made thereon within the spirit of the invention.

We claim:

1. A blister package storing a group of oral hygiene applicators, each formed from a circular base having bristles anchored therein impregnated with a dentifrice, the underside of the base being coated with a layer of pressure-sensitive adhesive whereby when the applicator is adhered to a user's finger tip it then functions as a toothbrush; said package comprising:

A. a card formed of transparent synthetic plastic material molded to define a group of round blisters projecting above a planar surface of the card; and B. a backing sheet sealed to said planar surface having seated thereon said group of applicators at positions in registration with said blisters whereby each blister houses a respective applicator; the base of each applicator being lightly adhered by its adhesive layer to said backing sheet whereby when the backing sheet is peeled off the card, it carries with it the applicator which can then be detached therefrom and adhered to the user's finger tip.

2. A package as set forth in claim 1, in which the backing sheet is formed from a metal foil and paper laminate, the applicators being seated on the foil side of the backing sheet.

3. A package as set forth in claim 2, in which the foil side is coated with a release agent whereby the applicator seated thereon is easily detached.

4. A package as set forth in claim 1, in which the backing sheet is formed from a metal foil and paper laminate, the applicators being seated on respective paper discs bonded to the foil side of the backing.

5. A package as set forth in claim 1, in which the package is divided by perforations into sections each containing an applicator, whereby to use an applicator one first tears of the section containing the applicator.

6. A package as set forth in claim 5, in which the package contains a rectangular array of six blisters with an applicator nested in each blister.

7. A package as set forth in claim 1, in which the card is formed of a thermoplastic material and said backing is sealed thereto by heat and pressure.

8. A package as set forth in claim 1, in which the card has the dimensions of a standard credit card.

* * * * *